US005577126A

United States Patent [19]

Klippel

[11] Patent Number: 5,577,126

[45] Date of Patent: Nov. 19, 1996

[54] OVERLOAD PROTECTION CIRCUIT FOR TRANSDUCERS

[76] Inventor: Wolfgang Klippel, Altenberger Str. 11, 01277 Dresden, Germany

[21] Appl. No.: 311,196

[22] Filed: Sep. 26, 1994

[30] Foreign Application Priority Data

Oct. 27, 1993 [DE] Germany ..... 43 36 608.2

[51] Int. Cl.[6] ..... H04R 29/00

[52] U.S. Cl. ..... 381/59; 381/55; 381/96; 381/98; 381/106; 381/107; 381/108; 330/279; 330/129; 330/278

[58] Field of Search ..... 381/107, 108, 381/106, 96, 98, 59, 55; 330/279, 129, 278; 333/14

[56] References Cited

U.S. PATENT DOCUMENTS

| | | |
|---|---|---|
| 3,890,465 | 7/1973 | Kaizu . |
| 3,959,736 | 6/1975 | Grosjean . |
| 4,023,074 | 11/1975 | Fichtner . |
| 4,093,822 | 3/1977 | Steinle . |
| 4,296,278 | 1/1979 | Cullison . |
| 4,301,330 | 9/1979 | Trump . |
| 4,330,686 | 12/1979 | Roe . |
| 4,490,770 | 6/1981 | Phillimore . |
| 4,583,245 | 6/1984 | Gelow . |
| 4,864,624 | 3/1988 | Tichy . |

FOREIGN PATENT DOCUMENTS 0108497 6/1984 Japan ..... 381/108

OTHER PUBLICATIONS

Klippel, W.: The Mirror filter–a New Basis for Reducing Nonlinear Distortion Reduction and Equalizing Response in Woofer Systems, J. Audio Eng. Soc. 32 (9), pp. 675–691, (1992).

*Primary Examiner*—Curtis Kuntz
*Assistant Examiner*—Minsun Oh

[57] ABSTRACT

This invention relates to an arrangement (1) for protecting transducer (3) which converts an electric signal into an acoustic or a mechanic signal against overload and destruction. The arrangement is connected to the electric terminals of the transducer (3) and changes the electric input signal under overload condition. A reference filter (6) connected with the electric input of the transducer provides a monitored signal x(t) related to the load of the transducer (3) to a controller (7). If the amplitude of the monitored signal x(t) exceeds an prescribed threshold value the controller (7) activates a feedback loop realized by the reference filter (6), multiplier (8) and summer (5). This invention provides an effective protection of the transducer with a minimum of elements by using the reference filter (6) as both a signal detector and a controlled attenuation element. Because the activated protection system has approximately the inverse transfer response of the reference filter the spectral components with the highest amplitude in x(t) are attenuated primarily.

6 Claims, 3 Drawing Sheets

OVERLOAD PROTECTION CIRCUIT FOR TRANSDUCERS

BACKGROUND OF THE INVENTION

1. Field of the Invention

The invention is related to an arrangement coupled to a transducer which converts an electric signal to an acoustic or a mechanic signal for protecting the transducer against destruction caused by high amplitudes in transducer variables (temperature, displacement, force, stress, . . . ). The arrangement is connected to the electric transducer input and attenuates the electric signal supplied to the transducer in case of overload.

2. Description of the Prior Art

Transducers converting an electric signal into an acoustic or a mechanic signal (loudspeakers, headphones and actuators) can be endangered to malfunction or permanent destruction when a electric or mechanic variable in the transducer exceeds an allowed limit value. For example, the displacement of the voice coil of an electrodynamic transducer is limited by the geometry of the suspension and the motor structure.

Overloading the transducer can be prevented by operating the transducer with an amplifier supplying a maximal output power lower than the power handling capacity of the transducer. Input signals with high amplitude will always be limited by the amplifier and will not endanger the transducer. However, unpleasant distortions are generated if the amplifier is limiting.

Protecting the transducer by amplifier limiting is unacceptable in professional sound enhancement and initialized the development of special protection systems as disclosed in U.S. patent application Ser. No. 4490770 by H. R. Phillimore entitled OVERLOAD PROTECTION OF LOUDSPEAKERS, U.S. patent application Ser. No. 4330686 by R. Stephen entitled LOUDSPEAKER SYSTEMS, U.S. patent application Ser. No. 4301330 by T. Bruce entitled LOUDSPEAKER PROTECTION CIRCUIT, U.S. patent application Ser. No. 4296278 by S. B. Cullison entitled LOUDSPEAKER OVERLOAD PROTECTION CIRCUIT and U.S. patent application Ser. No. 3890465 by Y. Kaizu entitled CIRCUIT ARRANGEMENT FOR PROTECTION OF A SPEAKER SYSTEM. These systems will successfully protect the transducer against thermal overload related to the electric power supplied to the transducer but fail in the protection of the transducer against mechanical destruction caused by high amplitudes of mechanical variables.

Another protection circuit disclosed in U.S. patent application Ser. No. 4583245 by W. Gelow entitled SPEAKER SYSTEM PROTECTION CIRCUIT uses filters with controllable cutoff frequency for "altering the frequency range or speaker driving signal so as to remove the overload condition". A similar protection system described in *The Mirror filter—a New Basis for Reducing Nonlinear Distortion Reduction and Equalizing Response in Woofer Systems* by W. Klippel in J. Audio Eng. Soc. 32 (9), pp. 675–691, (1992) prevents clipping and mechanical damage caused by high voice coil displacement of an electrodynamic loudspeaker. The Mirror filter contains a linear reference filter with a transfer function $H_x(S)$ adjusted to the loudspeaker and provides an output signal x(t) related to the displacement of the voice coil. This reference filter is useful for monitoring the loudspeaker's displacement without a sensor and dispenses from additional sensing lines for feeding back the displacement signal into the protection circuit. The protection system contains a high-pass filter with controllable cutoff frequency. The high-pass filter is connected to the input of the mirror filter and provides a high-pass filtered input signal for the loudspeaker. For small voice coil excursion the protection system is not activated, and the filter cutoff frequency is at the low end of the audio range, about 20 Hz. If the voice coil displacement reaches the prescribed safe limit, the cutoff frequency of the high-pass filter is shifted upward, and the low frequency components are sufficiently removed from the system so that the displacement does not exceed the critical value. Thus distortion generation and the risk of destruction can be reduced by linear pre-filtering.

However, the protection systems of prior art has some disadvantages in practical implementation and in the performance with a real audio signal (music, speech).

Two filters have to implemented: One used as the reference filter for generating a signal related to the monitored transducer variable and another filter with controllable cut-off frequency for attenuating the electric input signal. The realization of the controllable high-pass filter is expensive because a complex circuit is required to fulfill the high performance requirements in the pass-band.

An important criteria of the performance is the reaction time which should be as short as possible to cope with steep attack slopes of transient input signals (e.g. signals from a bass drum). However, a controllable high-pass filter used as the attenuation element increases the reaction time of the protection system. If the protection system is not activated and the cut-off frequency is at the low end of the audio band (usually 20 Hz) the high-pass filter has a long impulse response. Supplying a transient input signal with high amplitudes, the cut-off frequency can not be increased in time to prevent an excess of the displacement over the allowed limit.

A short reaction time can be achieved by using an amplifier with controllable gain (VCA) instead of a high-pass filter with controllable cut-off frequency. However, the attenuation of all spectral component becomes audible and is superfluous if the overload is caused by a part of the spectrum.

A protection system having a transfer response under overload condition, which is directly related to the spectrum of the monitored signal, is not known in prior art.

Thus, there is a need for a protection circuit for loudspeakers which can provide an improved protection of the loudspeaker against electrical and mechanical overload caused by an arbitrary electric signal u(t), such as music, speech, secondary sound in active noise control.

A protection circuit is required which has a very short reaction time for coping with transient signals of high amplitude and for attenuating the electric signal at the transducer input in time.

Another object of the invention is to provide protection of the loudspeaker while causing a minimal change of the input signal. Thus a minimal amount of linear and nonlinear distortions are generated by the protection circuit. A protection circuit is required that attenuates the spectral components of the electric signal causing the overload of the transducer primarily.

A final purpose is to provide a reliable protection which can be realized with fewer elements and less complexity than prior art and implemented in a digital signal processing system at low costs.

SUMMARY OF THE INVENTION

This invention protects a transducer, which converts an electric signal $U_L(t)$ into an acoustic or a mechanic signal, against overload and destruction. The protection circuit consists of a reference filter, a controller, a multiplier and a summer.

According to the invention the reference filter is used for two purposes. The first task is to provide a signal for the controller which is related to a physical variable in the transducer indicating an overload situation. The second purpose is to decrease the amplitude of those spectral components in tile input signal $U_L(t)$ which cause the overload situation. To solve the second task the output signal x(t) is multiplied with the controller output signal and is fed back to the input of the reference filter. Because the activated protection system has approximately the inverse transfer response of the reference filter the spectral components with the highest amplitude in x(t) are attenuated primarily. Thus the activated protection system produces a minimum of linear distortions while providing the most efficient protection of the transducer. The reaction time of the protection circuit, caused by the time constants of the controller and by the impulse response of the reference filter, is shorter than in protection circuits using an additional attenuation filter with controllable cut-off frequency.

This invention provides an improved performance and can be implemented with fewer elements than protection systems in prior art. Thus the head room of the transducer, which is required without or insufficient protection can be reduced. Driving the loudspeaker at a higher amplitude without exposing the transducer to danger results in a higher output amplitude (e.g. increased sound pressure level). Thus transducer with a smaller volume of the enclosure and a smaller weight can produce the required amplitude of the mechanic or acoustic output signal.

DETAILED DESCRIPTION

Figure 1:
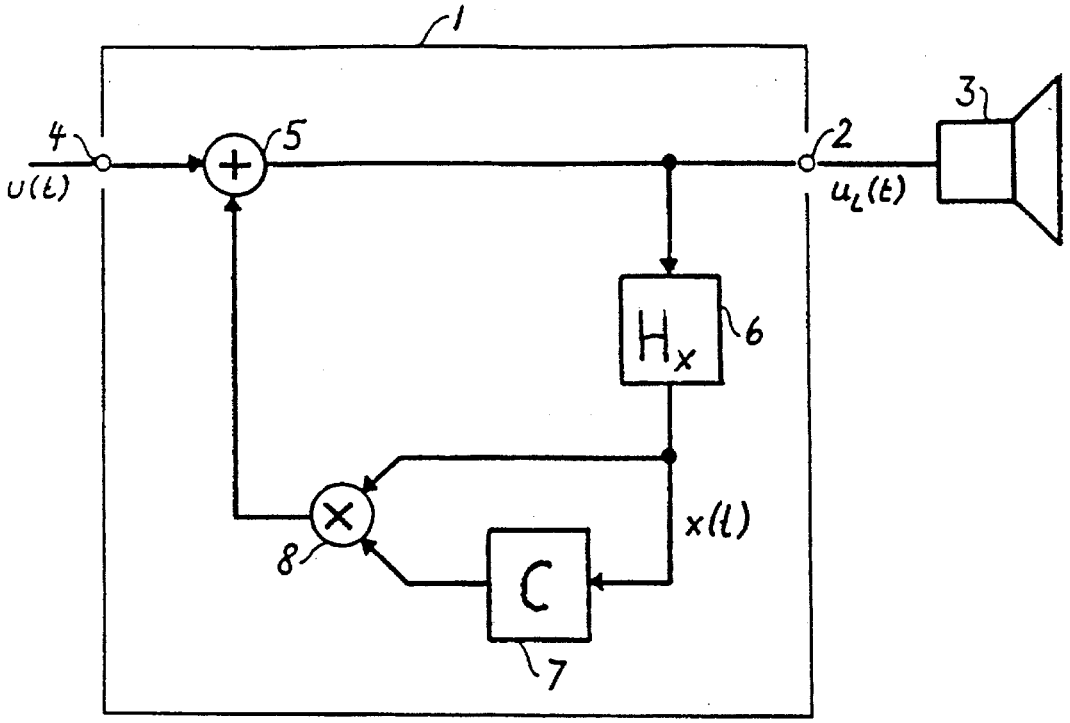
FIG. 1 is a schematic flow diagram of the protection circuit without correction filter.

FIG. 1 shows a first embodiment of the protection circuit according to the invention. The protection circuit 1 connected via output 2 with the transducer 3 comprises a summer 5, a reference filter 6, a controller 7 and a multiplier 8. This protection circuit has a closed loop structure: The input 4 providing the input signal u(t), e.g. music, speech, is connected via summer 5 with both output 2 and input of the reference filter 6. The output of the reference filter 6 is connected both to the first input of multiplier 8 and via the controller 7 to the other input of the multiplier 8. The output of multiplier 8 is connected to the other input of summer 5 realizing a feedback system.

The reference filter 6 is a linear filter with the system function $H_x(S)$ related to the transducer 2 and provides a signal x(t) indicating an overload situation.

The control circuit 7 is a nonlinear, dynamic system with the following relationship $$\alpha(t)=F(x(t)) \tag{1}$$

between input signal x(t) and the output signal α(t). The function F corresponds with a limit value S for activating the protection system and provides optimal time characteristics of the protection system matching psychoacoustic demands. If the monitored signal x(t) is lower than a limit value S the controller output signal α(x)=0 and the protection circuit is not activated. If the monitored signal x(t)>S the control signal becomes α(t)<0 and the protection circuit 1 has the following system function $$H_s(s)=\frac{U_L(s)}{U(s)}=\frac{1}{1-\alpha H_x(s)}\,. \tag{2}$$

The controller has some memory and different transient behavior for the attacking and decaying slopes to achieve a short reaction time and to avoid audible modulation of the signal.

In the activated protection system the reference filter 6 is part of a feedback loop and the system function $H_x(S)$ of the filter is part of the denominator in the right term of Eq. (2). Consequently, there is between $H_S(S)$ and $H_x(S)$ an almost inverse relationship. The spectral components in x(t) which have the highest amplitude and endanger the transducer will be attenuated by the protection circuit most of all. According to this important feature the activated protection circuit is very effective and causes only a minimum of linear and nonlinear distortion in the transferred signal.

The general principle of the protection circuit shall be illustrated using a practical example: The protection of a woofer loudspeaker against high voice coil displacement. For an electrodynamic loudspeaker mounted in a sealed enclosure the reference filter has the transfer function $$H_x(s)=\frac{1}{\frac{s^2}{\omega_L^2}+\frac{1}{Q}\frac{s}{\omega_L}+1} \tag{3}$$

with the resonance frequency $\omega_L=2\pi f_L$, the loss factor Q and the complex Laplace operator S.

If the protection system is activated the total system function $$H_G(s)=\frac{X(s)}{U(s)}=H_s(s)H_x(s) \tag{4}$$

between the Laplace-transformed electric signal U(S)=L{u(t)} at input 4 and Laplace-transformed voice coil displacement X(S)=L{x(t)} can be determined by combining Eq. (2) and Eq. (3) resulting in $$H_G(s)=\frac{1}{(1-\alpha)\left[\left(\frac{s}{\omega_s}\right)^2+\frac{1}{Q_s}\frac{s}{\omega_s}+1\right]} \tag{5}$$

with the cut-off frequency $$\omega_s=\omega_L\sqrt{1-\alpha} \tag{6}$$

and the loss factor $$Q_s=Q\sqrt{1-\alpha}\,. \tag{7}$$

of the overall system.

Eq. (5) shows that the overall system has still a low-pass characteristic and the control signal α(t), with α(t)<0, diminishes the gain $$H_G(\omega)\approx\frac{1}{1-\alpha}\quad\text{for }\omega<\omega_s \tag{8}$$

at lower frequencies and increases the cut-off frequency $\omega_S$ to control the displacement of the loudspeaker to the prescribed limit S. The frequency response at higher frequencies ($\omega > \omega_S$) and so the gain in the pass-band of the sound pressure response is not changed.

Figure 2:
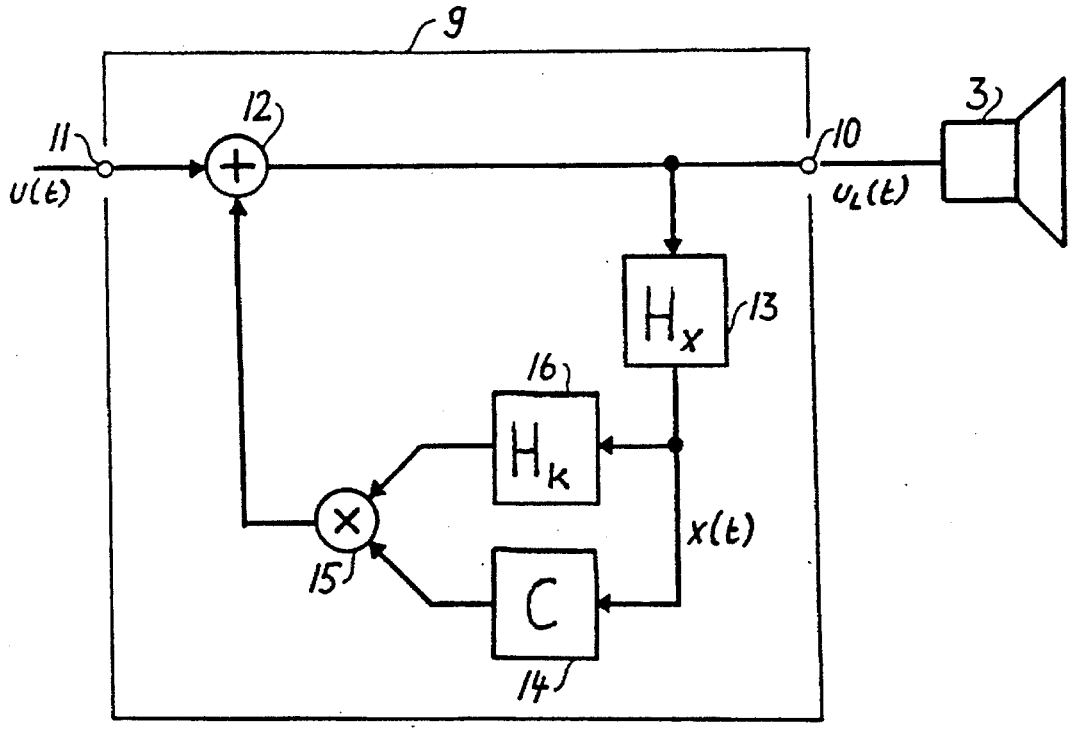
FIG. 2 shows the schematic flow diagram of the protection circuit with correction filter.

FIG. 2 shows a further embodiment of the invention. The protection circuit 9 comprises a summer 12, a reference filter 13, a controller 14 and a multiplier 15 which correspond with the elements 5, 6, 7, 8 of the protection circuit 1. In contrast to the protection circuit 1 shown in FIG. 1 the direct connection between the output of reference filter 6 to the first input of the multiplier 11 is substituted by an additional correction filter 16. This filter 16 allows to realize a desired frequency characteristic of the attenuation system which is not related to the frequency characteristic of the reference filter 6 used for monitoring a transducer signal.

The purpose of the correction filters shall be illustrated in correcting the total loss factor $Q_S$ in the woofer system with activated protection system. The increase of the loss factor $Q_S$ with $|\alpha(t)|$ according to Eq. (7) can be prevented by using all additional correction filter 16 with the system function $$H_k(S)=Ls+1 \tag{9}$$

Figure 3:
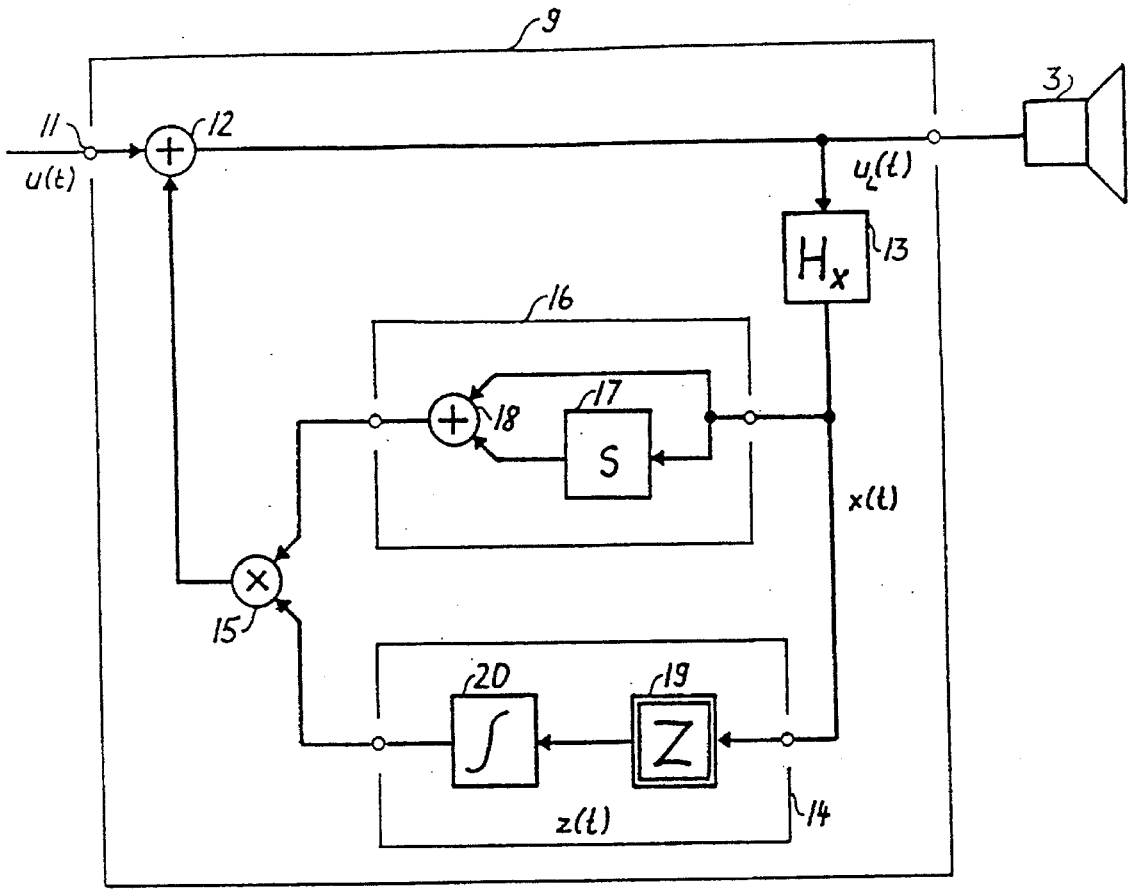
FIG. 3 shows a protection circuit with correction filter in detail.

Eq. (9) can be realized by a direct path and a first-order differentiator 17 with the gain connected in parallel by summer 18 as shown in FIG. 3.

The system function of the activated protection system 9 is $$H_s(s)=\frac{1}{1-\alpha H_k(s)H_x(s)} \tag{10}$$

using the system function $H_x(S)$ of the reference filter 13 according Eq. (3) which models the closed-box woofer system 3.

The woofer 3 with activated protection system 9 has a total system response $H_G(S)$ described by Eq. (5) with the cut-off frequency described by Eq. (6) and a modified total loss factor $$Q_s=Q\frac{\sqrt{1-\alpha}}{1-\omega_L QL\alpha}. \tag{11}$$

Choosing a appropriate parameters ($L \geqq 0$) the variation of the total loss factor $Q_S$ can be reduced or even decreased supporting the attenuating effect.

FIG. 3 shows the embodiment of the correction filter 16 and control system 14 in details. The control system 14 comprises a static nonlinearity 19 and a integrator 20 connected to the output of the nonlinearity 19. The nonlinearity 19 may be realized by a diode-network by using analog discrete elements or can be implemented in a DSP by a look-up table or a simple test according $$z(t)=\left\{\begin{array}{ll} 0 & \forall|x(t)|<S, \\ S-|x(t)| & \forall|x(t)|\geqq S \end{array}\right\}. \tag{12}$$

The output signal z(t) is zero as long as the monitored signal x(t) is below an threshold value S.

The element 20 is a leakage integrator with a short time constant for the attack slope (usually below 1 ms) and a long time constant for the decay (usually above 1 s) to avoid audible modulations of the audio signals by the control signal.

Figure 4:
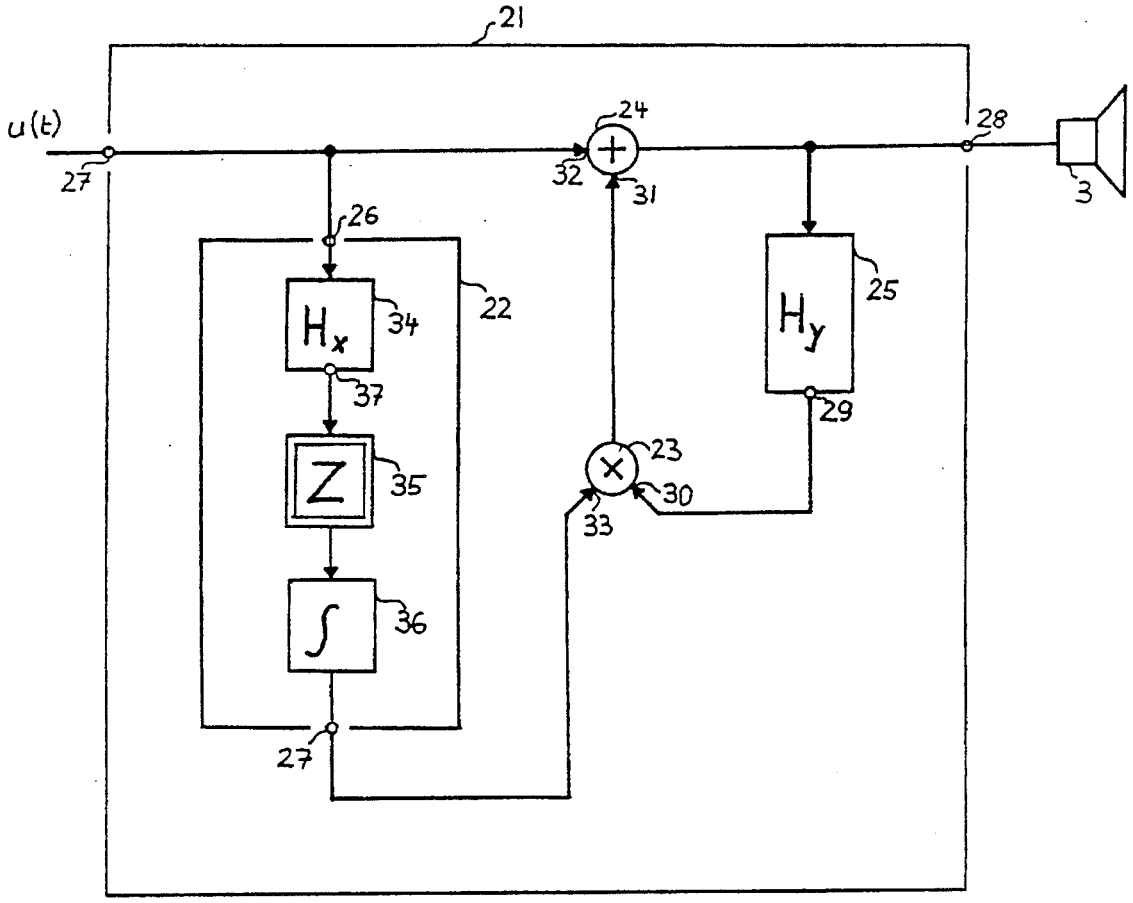
FIG. 4 shows an alternative embodiment of the invention using feed-forward control.

An alternative embodiment of the invention is shown in FIG. 4. The protection arrangement 21 comprises a controller 22, a multiplier 23, a summer 24 and a reference filter 25. The input 27 of the protection arrangement 21 is connected via input 32 of summer 24 both to the reference filter 25 and the output 28. The output 29 of the reference filter 25 is connected via the first input 30 of the multiplier 23 with the input 31 of the summer 24 forming a controlled feedback loop according to the invention. In contrast to the embodiments depicted in FIG. 1–FIG. 3 the controller is not part of the feedback loop but the input 26 of the controller 22 is connected to the input 27 of the protection circuit 21. The output 27 of the controller 22 is connected to the second input 33 of the multiplier 23. The controller 22 comprises a second reference filter 34, a nonlinear static circuit 35 and an integrator 36. The transfer responses of the filter 34 and filter 25 correspond with the transfer response of the transducer. Whereas the signal at output 29 corresponds with the monitored signal in the transducer with protection, the signal at output 37 of the filter 34 is the monitored signal of the transducer without protection. The static nonlinearity 35 realizes the desired control characteristic and the threshold value for attenuating the input signal. The integrator 36 prevents audible modulations of the electric signal in the same way as integrator 20.

The above description shall not be construed as limiting the ways in which this invention may be practiced but shall be inclusive of many other variations that do not depart from the broad interest and intent of the invention.

What is claimed is:

1. A protection arrangement coupled to the electric terminals of a transducer, which converts an electric signal into an acoustic or a mechanic signal, for protecting said transducer against destruction at high signal amplitude while producing a minimum of signal distortions, comprising a reference filter having a filter input connected to the electric input of said transducer, a filter output for providing a monitored signal indicating the load of said transducer;

a controller having a controller input and a controller output for providing a control signal if the amplitude of said monitored signal exceeds a prescribed threshold value;

a multiplier having a first input, a second input provided with said controller output and a multiplier output for controlling said monitored signal, said filter output being connected directly or via a correction filter with said first input of said multiplier;

a summer having a first input provided with the signal input of said arrangement, a second input provided with said multiplier output and a output connected to the electric input of said transducer for realizing a controlled feed-back system having the inverse transfer response of the reference filter approximately.

2. The invention according to claim 1 wherein said controller input is provided with said filter output.

3. The invention according to claim 2 wherein said controller comprises a static nonlinear circuit having an input connected with said controller input and an output, said static nonlinear circuit having a nonlinear transfer characteristic between said input and said output for providing a signal if the amplitude of the monitored signal exceeds an prescribed threshold value;

an integrator having an input connected to the output of said nonlinear circuit and an output connected to said control output for realizing a time characteristic of the controller which meets psychoacoustic requirements.

4. The invention according to claim 1 wherein said correction filter comprises a differentiator having an input connected with said filter output and a differentiator output for providing the time derivative of said monitor signal;

a summer having a first input connected to said filter output, a second input connected to the said differentiator output and an output connected via the output of said correction filter with the first input of said multiplier for realizing a transfer characteristic in the attenuation independent from the system response of said reference filter.

5. The invention according to claim 1 wherein said controller input is provided with the signal input of said arragement.

6. The invention according to claim 5 wherein said controller comprises a second reference filter having a filter input connected to said controller input and an output for providing a signal indicating the load of said transducer without protection arrangement;

a static nonlinear circuit having an input connected with the output of said second reference filter and an output, said static nonlinear circuit having a nonlinear transfer characteristic between said input and said output for providing a signal if the amplitude of the monitored signal exceeds an prescribed threshold value;

an integrator having an input connected to the output of said nonlinear circuit and an output connected to said control output for realizing a time characteristic of the controller which meets psychoacoustic requirements.

* * * * *